US005376514A

United States Patent [19]

Shinba et al.

[11] Patent Number: 5,376,514

[45] Date of Patent: Dec. 27, 1994

[54] SILVER HALIDE PHOTOSENSITIVE MATERIALS

[75] Inventors: Satoru Shinba; Toshihiko Kimura; Fumio Ishii, all of Hino, Japan

[73] Assignee: Konica Corporation, Japan

[21] Appl. No.: 206,898

[22] Filed: Mar. 4, 1994

Related U.S. Application Data

[63] Continuation of Ser. No. 917,788, Jul. 20, 1992, abandoned, which is a continuation of Ser. No. 794,597, Nov. 14, 1991, abandoned, which is a continuation of Ser. No. 419,969, Oct. 11, 1989, abandoned.

[30] Foreign Application Priority Data

Oct. 17, 1988 [JP] Japan ..... 63-259584

[51] Int. Cl.[5] ..... G03C 1/035; G03C 7/34

[52] U.S. Cl. ..... 430/505; 430/551; 430/553; 430/567; 430/581

[58] Field of Search ..... 430/567, 552, 553, 505, 430/581, 551

[56] References Cited

U.S. PATENT DOCUMENTS

| | | | |
|---|---|---|---|
| 4,446,226 | 5/1984 | Yamashita et al. | 430/567 |
| 4,476,219 | 10/1984 | Sakanoue et al. | 430/553 |
| 4,507,386 | 3/1985 | Matsuzaka et al. | 430/567 |
| 4,743,532 | 5/1988 | Shibata et al. | 430/567 |
| 4,772,543 | 9/1988 | Sato et al. | 430/553 |
| 4,789,624 | 12/1988 | Sakanoue et al. | 430/553 |
| 4,791,051 | 12/1988 | Sakanoue et al. | 430/553 |
| 4,791,053 | 12/1988 | Ogawa | 430/567 |
| 4,839,268 | 6/1989 | Bando | 430/567 |
| 4,865,962 | 9/1989 | Hasebe et al. | 430/567 |
| 4,879,206 | 11/1989 | Asami | 430/567 |

FOREIGN PATENT DOCUMENTS

| | | | |
|---|---|---|---|
| 0073145 | 3/1983 | European Pat. Off. | 430/553 |
| 115305 | 8/1984 | European Pat. Off. . | |
| 252997 | 1/1988 | European Pat. Off. . | |
| 3626465 | 2/1987 | Germany . | |
| 2222243 | 9/1987 | Japan | 430/567 |

*Primary Examiner*—Lee C. Wright

*Attorney, Agent, or Firm*—Jordan B. Bierman

[57] ABSTRACT

A silver halide photosensitive photographic material comprising a support and provided thereon, photographic component layers including at least one silver halide emulsion layer is disclosed, wherein the photosensitive silver halide grains contained in all the silver halide emulsion layers have an average silver iodide content ranging from 0 to 3 mol % and contain at least silver bromide; and at least one of the silver halide emulsion layers contain a diequivalent phenolic cyan dye-forming coupler having a ureido group in a 2-position of a phenolic nucleus.

30 Claims, No Drawings

SILVER HALIDE PHOTOSENSITIVE MATERIALS

This application is a continuation of application Ser. No. 07/917,788, filed Jul. 20, 1992, now abandoned, which is a continuation of application Ser. No. 07/419,969, filed Oct. 11, 1989, now abandoned, which is a continuation of application Ser. No. 794,597, filed Nov. 14, 1991, now abandoned.

FIELD OF THE INVENTION

The present invention relates to silver halide color photosensitive materials and more particularly to silver halide color photosensitive materials which have excellent processing stability and scarcely degrade during preservation.

BACKGROUND OF THE INVENTION

Recently, silver halide color photosensitive materials have been improved in photosensitivity and image quality, and also researches have been made for improvement in the field of rapid processing.

Processing of photosensitive materials essentially consists of two processes, a color development process and a deslivering process. The deslivering process usually consists of a bleaching process and a fixing process, or a bleach-fix process. In processing of photosensitive materials, a water washing process and a stabilization process are optionally included in addition to the above-mentioned processes.

Various kinds of methods have been proposed to increase the processing speed. In order to increase the processing speed of photosensitive materials, there have been introduced various improvements in such fields as a composition of silver halide, a layer thickness, a coupler, and various kinds of additives. It has been known that the improvement by means of the composition of silver halide is effective in both the color developing process and the desilvering process. Especially, it is generally known that silver bromide or silver bromoiodide with a low content of silver iodide is effective in increasing the speed of development and improving desilvering. However, in the case of changing simply the composition of silver halide, the processing stability tends to deteriorate while the processing speed is increased. Controlling the stability of development has become increasingly important with the recent spread of mini-laboratories for photo-finishing and the tendency of low replenishment of a color developing solution.

On the other hand, because photosensitive materials for amateur use are exposed to various conditions in temperature and humidity, an aging stability of photosensitive materials has been an important subject up to this time. Especially when silver bromide or silver bromoiodide with a low content of silver iodide is used, degradation of the properties during preservation has been a serious problem. It is assumed that the degradation is caused by adsorption and desorption of spectral sensitizers or other additives to silver halide grains, and various kinds of things have been attempted to solve the problem, which has not yet been solved completely.

In order to increase a sensitivity of the photosensitive materials, various methods are proposed, such as incorporating AgX grains with a larger size, using a diequivalent coupler, and reforming a layer structure. The diequivalent coupler tends to be preferably used because it can reduce processing time and provide rapid processability attributable to a thinner layer thickness achieved by a reduced amount of silver halide as well as an improved sensitivity, while a sharpness of a formed dye image is improved. But, the diequivalent coupler tends to increase fluctuation of developing performances in an ordinary development process, and to degrade a preservability of the photosensitive materials.

Accordingly, stability in processing and improvement of preservability are indispensable to the photosensitive materials when a diequivalent coupler is used.

In the invention, it has been found that stability in processing and preservability can be simultaneously improved by using the photosensitive silver halide whose halide composition is regulated, in combination with a particular diequivalent coupler.

SUMMARY OF THE INVENTION

The object of this invention is to provide the silver halide color photosensitive photographic material comprising an excellent rapid processability, a high stability in processing, and an improved preservability.

The above object of the present invention is accomplished by a silver halide photosensitive photographic material having a support and provided thereon, the photographic component layers including at least one silver halide emulsion layer, wherein the photosensitive silver halide grains contained in the silver halide emulsion layers have an average silver iodide content of 0 to 3 mol % and contain at least silver bromide; and at least one of the silver halide emulsion layers contains a diequivalent phenolic cyan coupler with an ureido group in a 2-position of a phenolic nucleus.

DETAILED DESCRIPTION OF THE INVENTION

The silver halide grains contained in the silver halide emulsions of the invention have an average silver iodide content of preferably 0.05 to 2.5 mol %, and more preferably 0.10 to 2.0 mol %. The other silver halides than silver iodide are preferably silver bromide, however are not necessarily composed of silver bromoiodide. As far as the effect of the present invention is not badly affected, other silver halides, for instance, silver chloride, may be contained. The particles may be grown from seed grains and have an unequal silver halide composition.

The photographic material of the invention has preferably a blue-sensitive layer, a green-sensitive layer and a red-sensitive layer, each comprising a plurality of silver halide emulsion layers having a spectral absorption in the same wavelength region and different sensitivities.

In the invention, an average iodide content of 0 to 3 mol % in the silver halide grains contained in the photographic material means that an average silver iodide content in all the silver halides contained in the blue-sensitive, green-sensitive and red-sensitive silver halide emulsion layers is 0 to 3 mol %. Accordingly, each silver halide emulsion layer may not necessarily contain silver iodide of 0 to 3 mol %, and some layer may contain silver iodide of more than 3 mol %. The green-sensitive layer and the red-sensitive layer contain preferably silver iodide of 0 to 3 mol %.

The present invention is characterized by the average silver iodide content of 0 to 3 mol % contained in the photographic material.

In the silver halide emulsion of the present invention, the silver halide grains may be of an equal composition or of a core/shell type in which an inside and a surface of the grains differ in composition.

The core/shell type emulsion can be produced by the publicly known methods which are disclosed in Japanese Patent Publication Open to Public Inspection (hereinafter, referred to as Japanese Patent O.P.I. Publication) No. 177535/1984, 138538/1985, 52238/1984, 143331/1985, 35726/1985, and 258536/1985.

An average diameter of the silver halide grains contained in the emulsion of the present invention is preferably 0.05 to 10 μm, more preferably 0.1 to 5.0 μm, and most preferably 0.15 to 3.0 μm.

The silver halide grains of the present invention may be either of isotropic crystal such as cube, octahedron and tetradecahedron, or of aerotropic crystal such as sphere and disc. They may be of a combination of these crystal forms.

The silver halide emulsion of the present invention may be either monodispersed or polydispersed.

A preparation method for the silver halide emulsion of the present invention may be any methods including an acid method, a neutral method and an ammonia method; It also includes a one-sided mixing method, a simultaneous mixing method, and a combination thereof. A reverse mixing method and a controlled double-jet method can be also used.

A mixture of not less than two kinds of silver halide emulsion can be used as the silver halide emulsion of the present invention.

When the silver halide emulsion of the present invention is prepared, a silver halide solvent such as ammonia, thioether, thiocarbamide may be used.

A concrete explanation about the cyan coupler used in the present invention will be given as follows.

The diequivalent phenolic cyan coupler with an ureido group at 2-position preferably used in the invention is represented by Formula (CU):

Formula (CU)

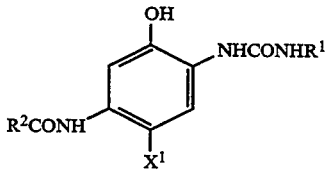

wherein $X^1$ represents a group which can be split off by coupling with an aromatic primary amine color developing agent; $R^1$ represents an aryl group or a heterocyclic group and $R^2$ represents an aliphatic group or an aryl group; the groups represented by $R^1$ and $R^2$ may have a substituent; a polymer dimeric or polymeric coupler formed by $R^1$ or $R^2$ is included; $R^1$ and $R^2$ have independently or dependently to each other the form or size which is necessary to give antidiffusibility to the coupler represented by Formula (CU) and the dye formed by the coupler.

An aryl group represented by $R^1$ or $R^2$ includes a phenyl group and a naphthyl group.

The substituents for $R^1$ and $R^2$ include a halogen atom and the groups of nitro, cyano, alkyl, aryl, amino, hydroxy, acyl, alkoxycarbonyl, aryloxycarbonyl, alkylsulfonyl, arylsulfonyl, alkoxysulfonyl, aryloxysulfonyl, carbamoyl, sulfamoyl, acyloxy, carbonamide, sulfonamide. The number of the substituent is preferably 1 to 5. When the number is not less than 2, each substituent may be either the same or different. An alkylsulfonyl group, a cyano group, and a halogen atom are preferable as the substituent for $R^1$.

$R^2$ is preferably represented by Formula (CU-II):

Formula (CU-II)

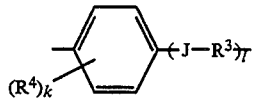

wherein J represents an oxygen atom or a sulfur atom; $R^3$ represents an alkylene group and $R^4$ represents a substituent; K represents an integer of 0 to 4, and λ represents 0 or 1, provided that when K is not less than 2, $R^4$ may be the same or different. The substituents represented by $R^4$ include the groups of alkyl, aryl, alkoxy, aryloxy, hydroxy, acyloxy, alkylcarbonyloxy, arylcarbonyloxy, carboxy, alkoxycarbonyl, aryloxycarbonyl, alkylthio, acyl, acylamino, sulfonamide, carbamoyl, sulfamoyl. The groups represented by $X^1$ include a halogen atom, an aryloxy group, an alkyloxy group, an arylthio group, an alkylthio group, a carbamoyloxy group, a carbamoylmethoxy group, an acyloxy group, a sulfonamide group, a succinateimide group, each of which contains an oxygen atom, a sulfur atom or a nitrogen atom directly combined with a coupling position. The examples thereof can be found in U.S. Pat. Nos. 3,476,563 and 3,749,735, Japanese Patent O.P.I. Publication No. 37425/1972, Japanese Patent Publication No. 36894/1974, Japanese Patent O.P.I. Publication No. 10135/1975, 117422/1975, 130441/1975, 108841/1976, 120334/1975, 18315/1977, 105226/1978.

The phenolic cyan coupler with an ureido group at a 2-position may be used together with other cyan couplers, preferably in a ratio of not less than 10 mol %.

The examples of the phenolic couplers with an ureido group at a 2-position are shown as follows.

CU-1

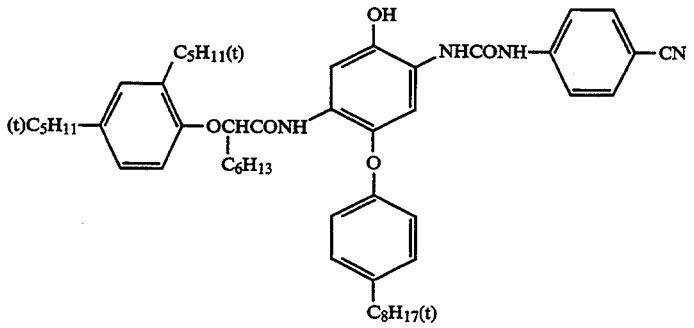

-continued
CU-2
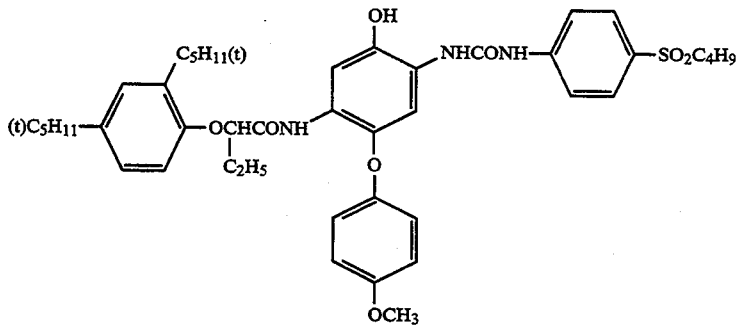
CU-3
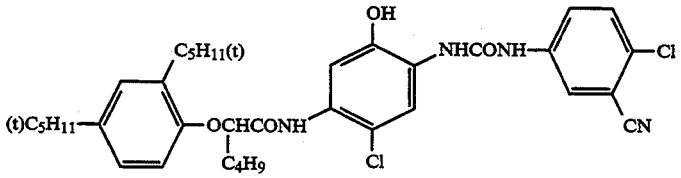
CU-4
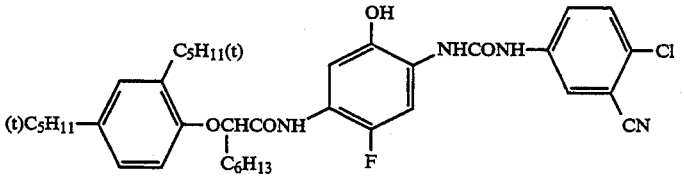
CU-5
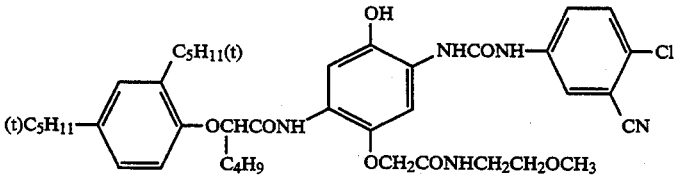
CU-6
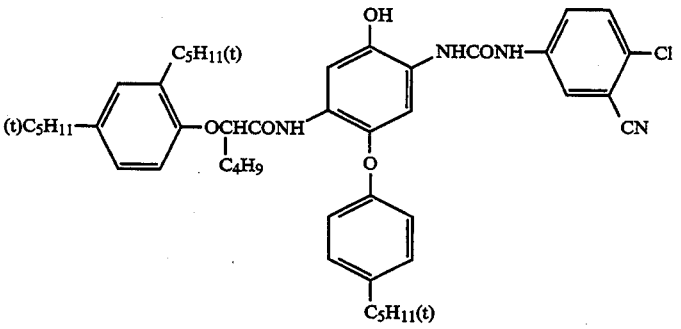
CU-7
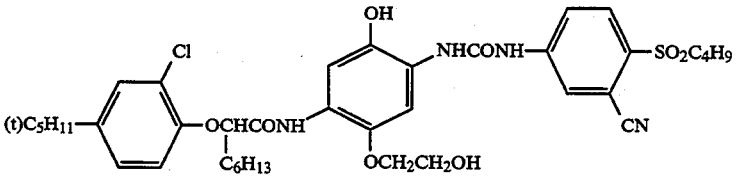

-continued
CU-8
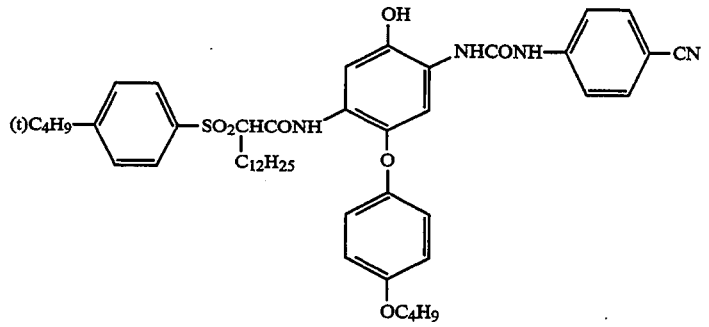
CU-9
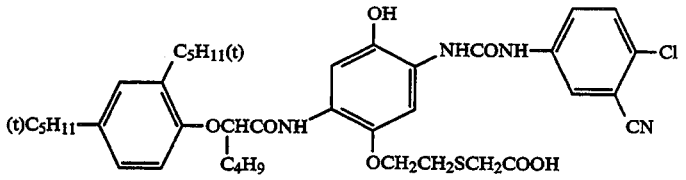
CU-10
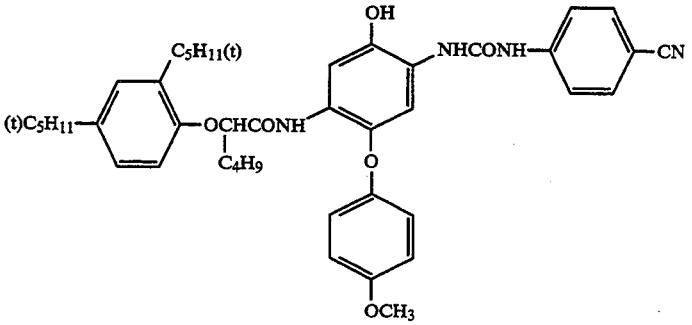
CU-11
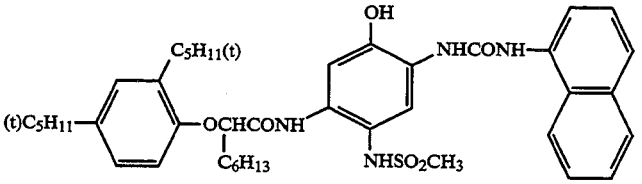
CU-12
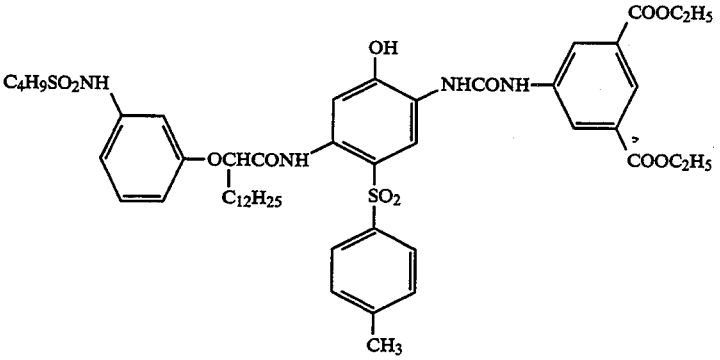

-continued
CU-13
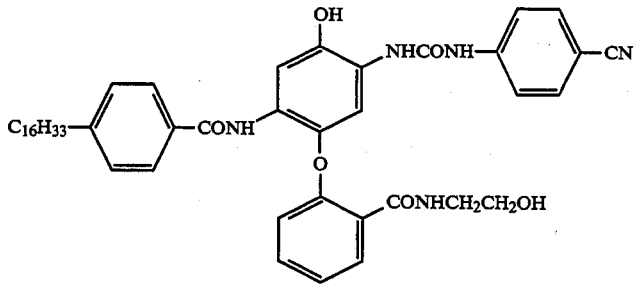
CU-14
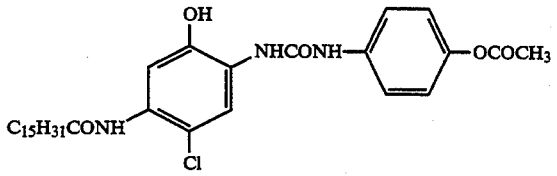
CU-15
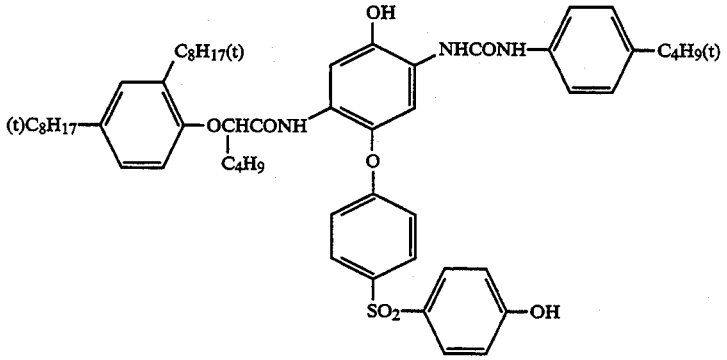
CU-16
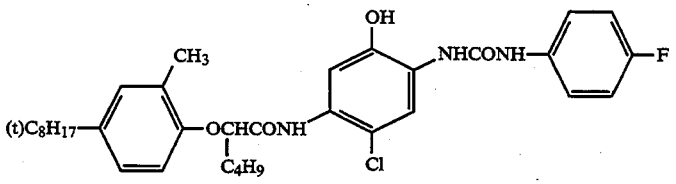
CU-17
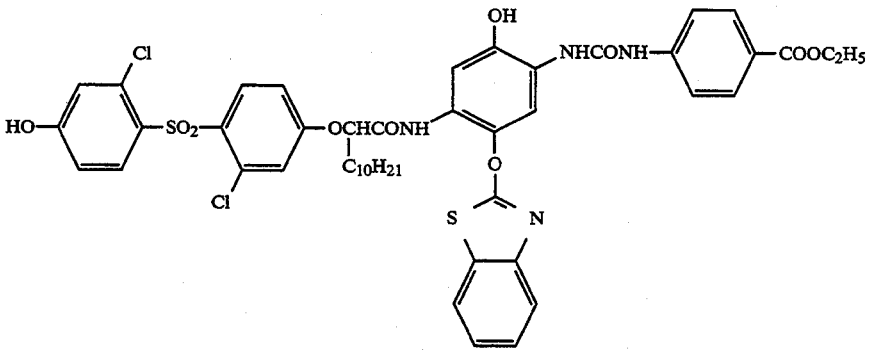
CU-18
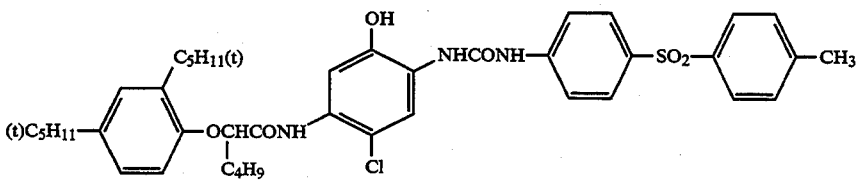

-continued
CU-19
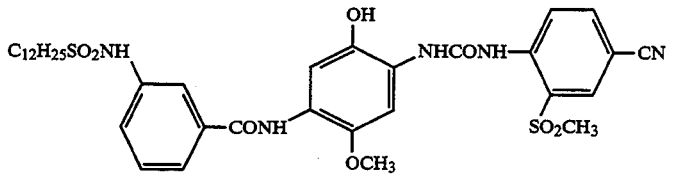
CU-20
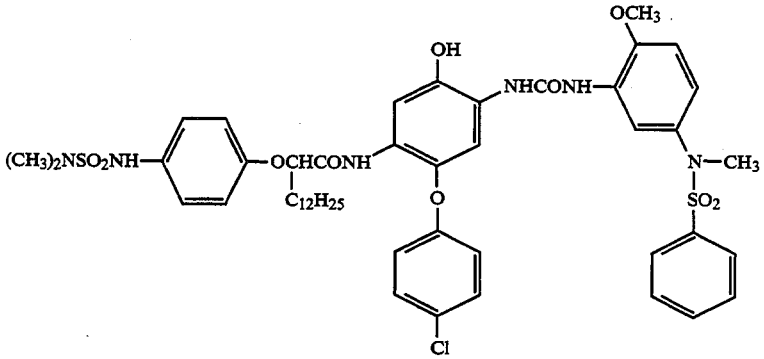
CU-21
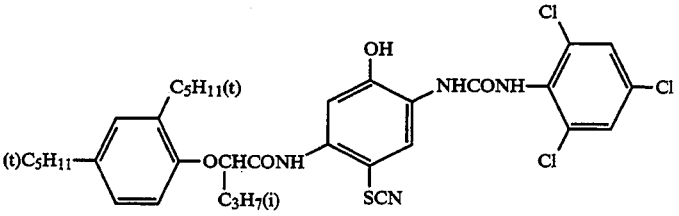
CU-22
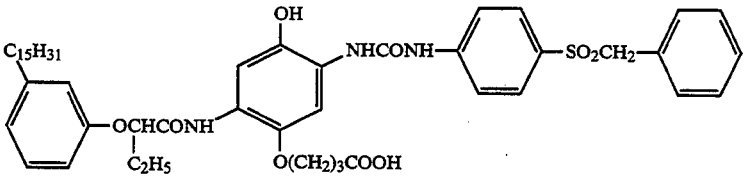
CU-23
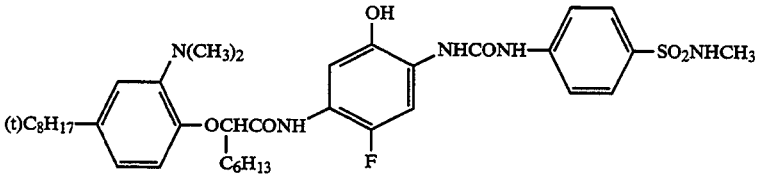
CU-24
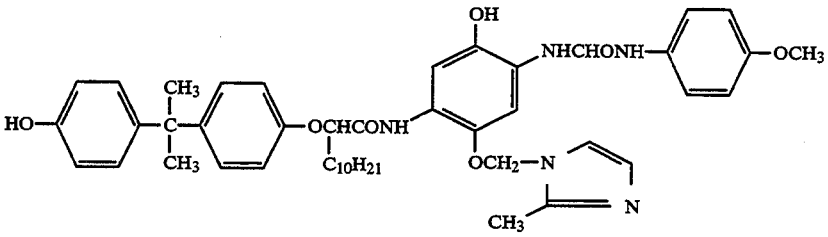
CU-25
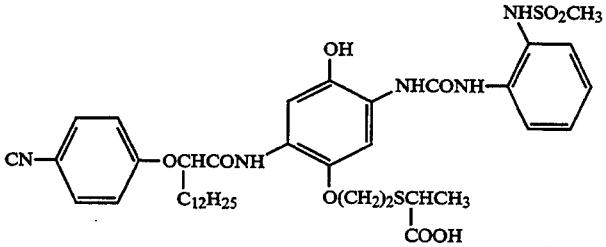

-continued
CU-26
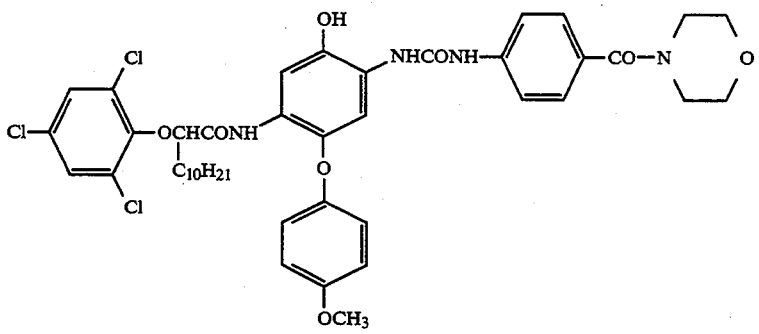
CU-27
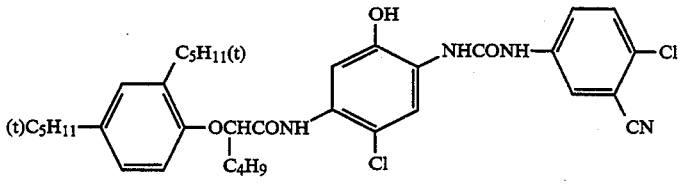
CU-28
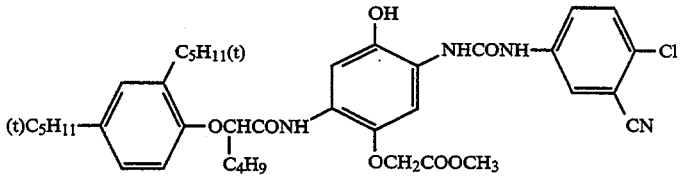
CU-29
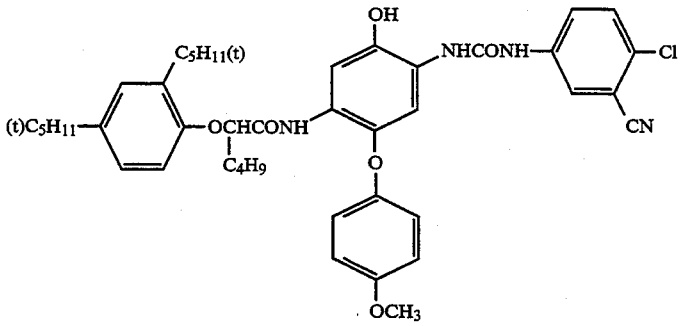
CU-30
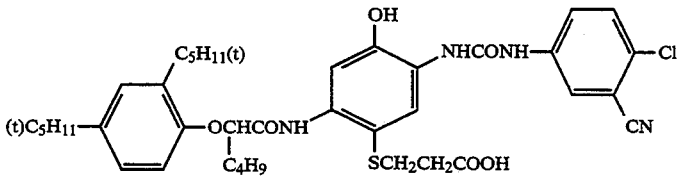
CU-31
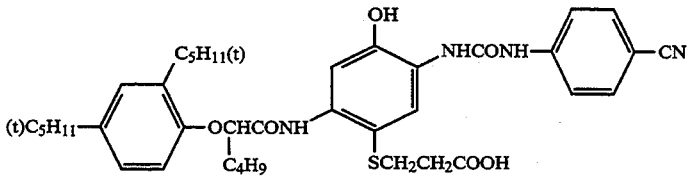
CU-32
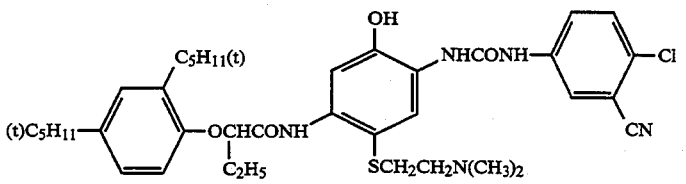

-continued
CU-33
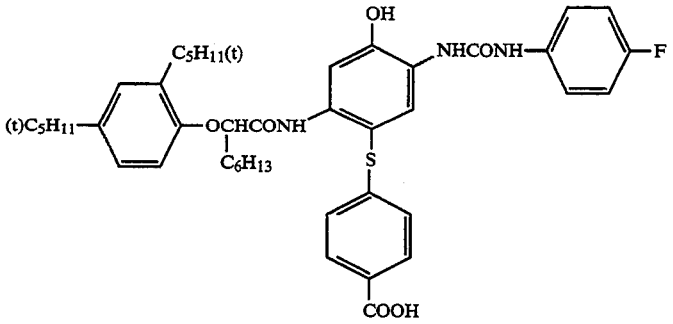
CU-34
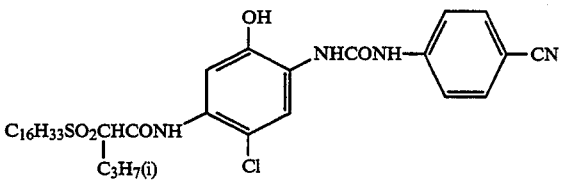
CU-35
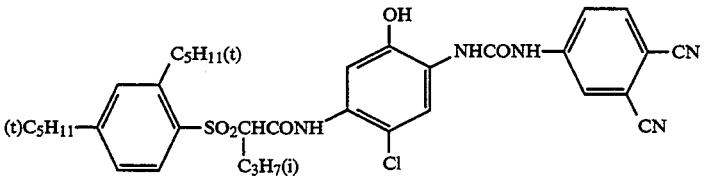
CU-36
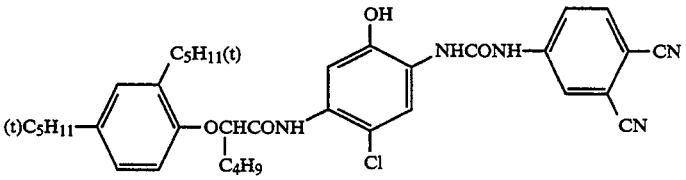
CU-37
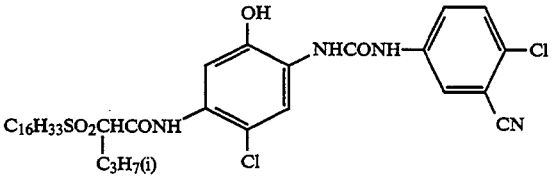
CU-38
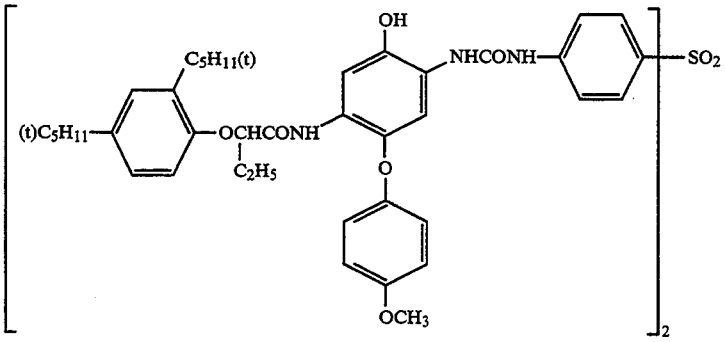

-continued

CU-39

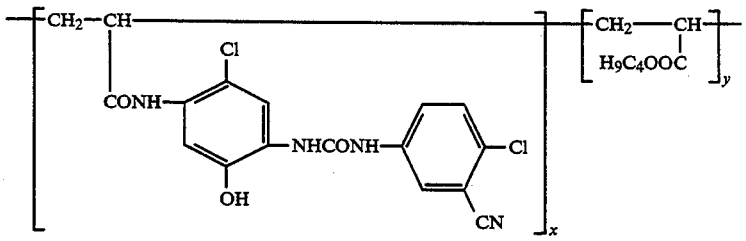

x:y = 50:50 (weight ratio)

CU-40

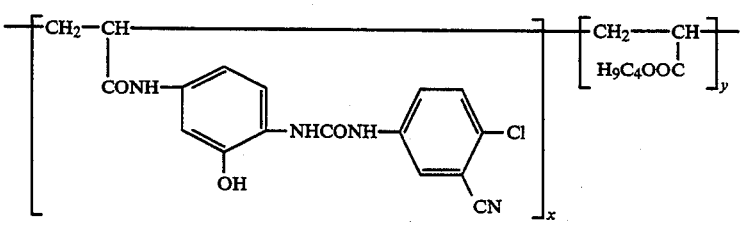

x:y = 50:50 (weight ratio)

The examples of the phenolic couplers with an ureido group other than the examples described before are disclosed in Japanese Patent O.P.I. Publication No. 65134/1981, 204543/1982, 204544/1982, 204545/1982, 33249/1983, 33253/1983, 98731/1983, 118643/1983, 179838/1983, 187928/1983, 65844/1984, 71051/1984, 86048/1984, 105644/1984, 111643/1984, 111644/1984, 131939/1984, 165058/1984, 177558/1984, 180559/1984, 198455/1984, 35731/1985, 37557/1985, 49335/1985, 49336/1985, 50533/1985, 91355/1985, 107649/1985, 107650/1985, and 2757/1986.

An addition amount of the phenolic coupler with an ureido group is preferably $1.0\times10^{-3}$ tool to 1.0 tool per mol of silver halide, and more preferably $3.0\times10$ mol to $6.0\times10^{-1}$ tool.

In the present invention, ester and/or amide of gallic acid are preferably used in order to improve a processing stability and prevent a degradation of the properties of the photosensitive materials in preservation. Especially, the compounds represented by Formula I and Formula II are preferably used:

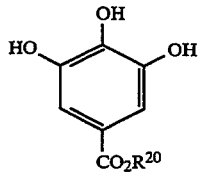

Formula I

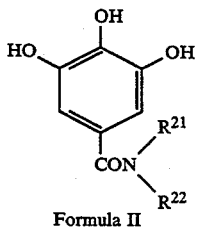

Formula II wherein $R^{20}$, $R^{21}$ and $R^{22}$ represent independently a hydrogen atom, an aliphatic group, an aromatic group, and a heterocylic group.

In the formulas I and II, the aliphatic groups represented by $R^{20}$, $R^{21}$ and $R^{22}$ include an alkyl group, an alkenyl group, a cycloalkyl group, and an alkinyl group, wherein the alkyl group has preferably 1 to 30, more preferably 1 to 20 carbon atoms, such as methyl, ethyl, propyl, n-butyl, sec-butyl, t-butyl, n-hexyl, 2-ethylhexyl, n-octyl, t-octyl, n-dodecyl, n-hexadecyl, n-octadecyl, isostearyl, and eicosyl;

The alkenyl group has preferably 2 to 30, more preferably 3 to 20 carbon atoms, such as allyl, butenyl, propenyl, octenyl, dodecenyl, and oleyl;

The cycloalkyl group is a 3-to 12-membered, preferably 5-to 7-membered ring such as cyclopropyl, cyclopentyl, cyclohexyl, cycloheptyl, and cyclododecyl;

The alkinyl group has preferably 3 to 30, more preferably 3 to 22 carbon atoms, such as propargyl and butynyl.

The aromatic group represented $R^{20}$, $R^{21}$ and $R^{22}$includes a phenyl group and a naphthyl group.

The heterocylic group represented by $R^{20}$, $R^{21}$ and $R^{22}$ includes a thiazolyl group, an oxazolyl group, an imidazolyl group, a furyl group, a thienyl group, a tetrahydrofuryl group, a piperidyl group, a thiadiazolyl group, an oxadiazolyl group, an benzothiazolyl group, a benzoxazolyl group, and a benzimidazolyl group.

Furthermore, these groups may have the substituents including an alkoxy group, an aryloxy group, a hydroxy group, an alkoxycarbonyl group, an aryloxycarbonyl group, a halogen atom, a carboxy group, a sulfo group, a cyano group, an alkyl group, an alkenyl group, an aryl group, an alkylamino group, an arylamino group, a carbamoyl group, an alkylcarbamoyl group, an arylcarbamoyl group, an acyl group, a sulfonyl group, a acyloxy group, and an acylamino group.

It is the most preferable that ester and amide of gallic acid used in the present invention are added to a silver halide emulsion layer. They may also be added to the nonsensitive layers such as an interlayer, a protective layer, a yellow filter layer, and an antihalation layer.

They may also be added to both the silver halide emulsion layers and the nonsensitive layers.

In the case of adding them to the silver halide emulsion layer, they may be added at any time until coating of the emulsion, and preferably during chemical ripening to coating, more preferably after completion of chemical ripening. In the case of adding them to the nonsensitive layers, they may be added at any time until coating of the emulsion.

They may be added after dissolving in water, lower alcohol, ester or keton, which has compatibility with water, or a mixture thereof. They may be added dispersively after dissolving in a high boiling solvent. An amount of addition is preferably 0.01 g to 100 g, more preferably 0.05 g to 50 g per mol of silver halide. The amount of addition depends on the kinds of silver halide and compound.

When they are added to the nonsensitive layers such as an interlayer, a protective layer, a yellow filter layer, or an antihalation layer, it is preferably 0.01 g to 50 g more preferably 0.05 g to 10 g per of gelatin.

The examples of the compounds represented by Formulas (I) and (II) are shown below.

I-1

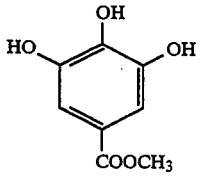

I-2

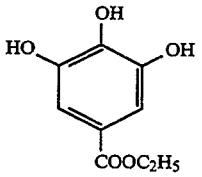

I-3

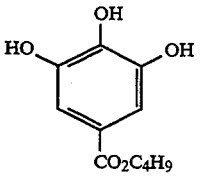

I-4

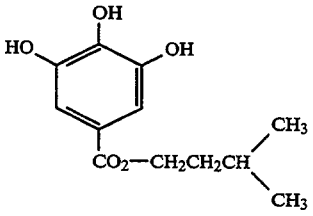

I-5

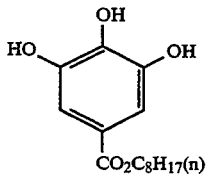

I-6

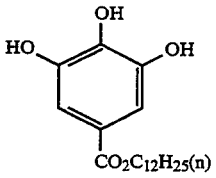

I-7

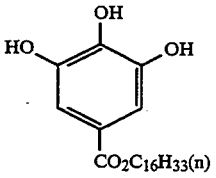

-continued

I-8

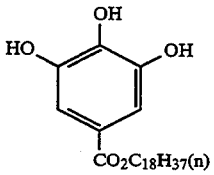

I-9

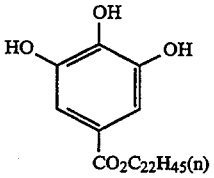

I-10

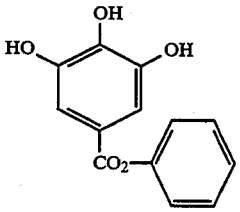

I-11

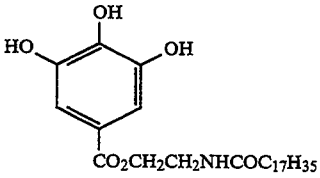

I-12

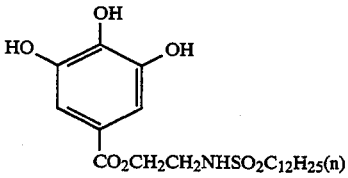

I-13

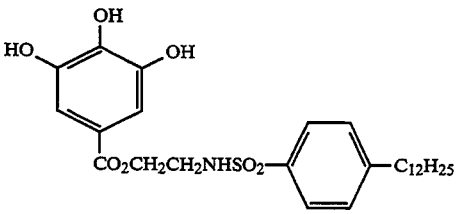

I-14

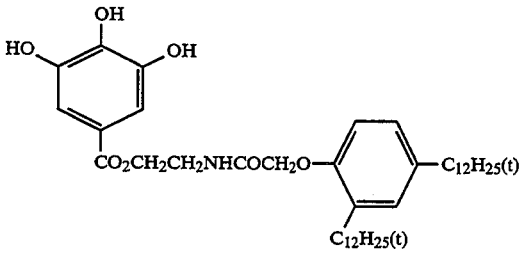

I-15

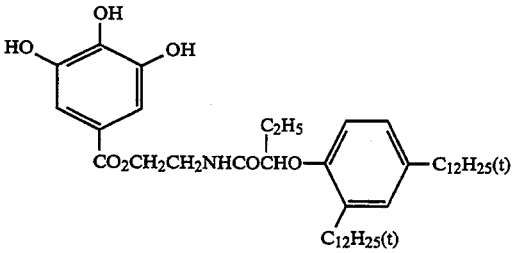

-continued

I-16

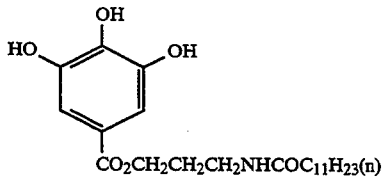

I-17

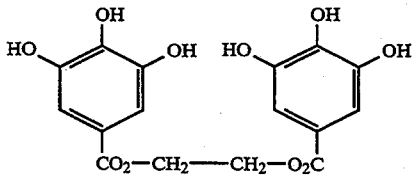

I-18

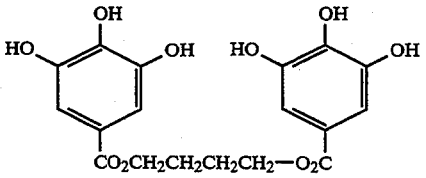

I-19

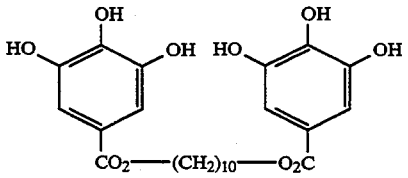

II-1

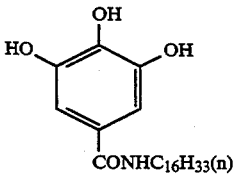

II-2

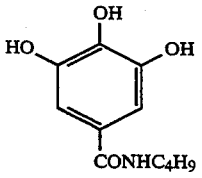

II-3

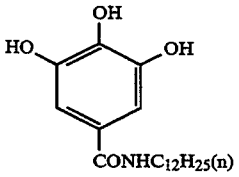

II-4

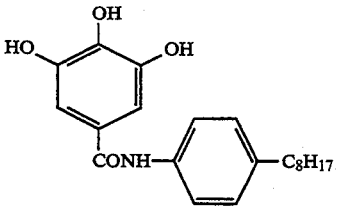

-continued

II-5

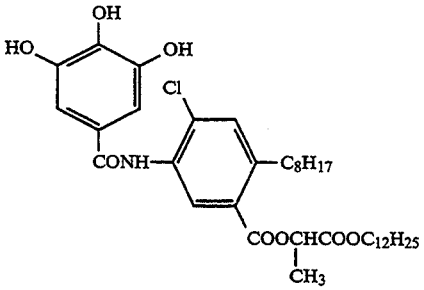

In the present invention, in order to obtain a wide latitude, it is possible to use a mixture of silver halide grains with varied average diameters. The silver halide grains which contain a desensitizer and are used instead of lower sensitive silver halide grains with a smaller grain diameter make it possible to reduce an average grain diameter without change of a sensitivity of silver halide grains, and further to use a mixture of silver halide grains having an equal average diameter and a different sensitivity.

In other words, even if the variation coefficient of the silver halide grains is reduced, a wide latitude can be obtained by using silver halide grains which contain a desensitizer. Accordingly, the silver halide grains with a smaller variation coefficient are preferable because the photographic properties can be made more stable against aging and development fluctuation. From the view point of production technique, it becomes possible that a mixture which is composed of silver halide grains with different sensitivities is sensitized chemically in the same batch.

An antifogging agent, a stabilizer, and a desensitizing dye can be used as a desensitizer besides a metallic ion. A metallic ion doping method is especially preferable.

The metallic ions which are used in the doping method include Cu, Cd, Zn, Pb, Fb, Tl, Rh, Bi, Ir, Au, Os, and Pb. They can be used either alone or in combination. The pH value of an AgX suspension in doping is preferably not less than 5.

A doped amount of metallic ions is usually $10^{-17}$ to $10^{-2}$ mol, and preferably $10^{-18}$ to $10^{-4}$ per mol of AgX.

When Rh is doped, the amount is preferably $10^{-14}$ to $10^{-2}$ mol, more preferably $10^{-11}$ to $10^{-4}$.

When the amount of doping is less than $10^{-2}$ mol/AgX, the growth of the grains is little influenced by it, and therefore, the silver halide grains whose diameters have a narrow distribution, can be provided. It is also possible that the silver halide grains which have different doping conditions are mixed in a prescribed ratio and arranged in the same batch to be subjected to chemical sensitization.

Unnecessary soluble salts may be removed from a physically ripened emulsion. The methods for this purpose include a noodle washing method and a flocculation method (the sedimentation method) in which a high molecular weight flocculant, a gelatin derivative, and an inorganic salt are utilized. The silver halide emulsion of the present invention may be chemically sensitized by the active gelatin sensitizing method, the noble metal sensitizing method, the sulfur sensitizing method, and the reduction sensitizing method. In the present invention, the emulsion is preferably subjected to sulfur sensitization with a conventional sulfur sensitizer. The sulfur sensitizers include thiosulphate, allylthiocarbamide, thiourea, allylisothiacyanate, and p-toluene thiosulfonate. The sulfur sensitizer is preferably added to the emulsion in an amount of about $10^{-7}$ to $10^{-1}$ tool per mol of silver halide.

Gold sensitization may be conducted as well as sulfur sensitization. The gold sensitizers include aurate chloride, potassium chloroaurate, auric trichloride, and potassium auricthiocyanate. The gold sensitizer is preferably added to the emulsion in an amount of about $10^{-7}$ tool to $10^{-1}$ per tool of silver halide.

When the silver halide emulsion of the present invention is sensitized by sulfur sensitization or gold sensitization, reduction sensitization may be applied together therewith. The reduction sensitizers include stannous chloride, thiourea dioxide, silane compound, and hydrazine derivative.

In the silver halide emulsion of the invention, it is preferable that the value obtained by multiplying an amount per tool of AgX of a sensitizing dye adsorbed to silver halide grains by an average grain size is not less than $2.55\times10^{-4}$.

The prescribed means may be taken in order to get the silver halide grains to adsorb the sensitizing dyes by the amount mentioned above.

The preferable method to increase the adsorption of the sensitizing dyes is to add an iodine compound to the emulsion. The iodine compound may be added to the emulsion at any time during growth of the silver halide grains through chemical ripening and coating. The amount of the iodine compound to be added is preferably $2\times10^{-6}$ tool to 1 mol, and more preferably $1\times10^{-4}$ mol to 1 mol per mol of silver halide. Addition may be once or several times.

The spectral sensitizers used in the invention include a cyanine dye, a merocyanine dye, a complex cyanine dye, a complex merocyanine dye, a holopolar cyanine dye, a hemicyanine dye, a styryl dye, and a hemioxanol dye.

Especially effective spectral sensitizers are cyanine dye, merocyanine dye, and complex merocyanine dye.

The spectral sensitizers used for a blue-sensitive silver halide emulsion layer include those described in West Germany Patent No. 929,080; U.S. Pat. Nos. 2,231,658, 2,493,748, 2,503,776, 2,519,001, 2,912,329, and 3,656,959, 3,672,897, 3,694,217, 4,025,349, and 4,046,572; U.K. Patent No. 1,242,588; Japanese Patent Publication No. 14030/1969, and 24844/1977. The spectral sensitizers used for a green-sensitive silver halide emulsion layer include a cyanine dye, a merocyanine dye, and a complex cyanine dye which are described in U.S. Pat. Nos. 1,939,201, 2,072,908, 2,739,149, 2,945,763, and U.K. Patent No. 505,979. The spectral sensitizers used for a red-sensitive silver halide emulsion layer include a cyanine dye, a merocyanine dye, and a complex cyanine dye which are described in U.S. Pat. Nos. 2,269,234, 2,270,378, 2,442,710, 2,454,629, and 2,776,280. A cyanine dye, a merocyanine dye, and a complex cyanine dye which are described in the U.S. Pat. Nos. 2,213,995, 2,493,748, 2,519,001, and West Germany Patent No. 929,080, also can be used for the green-sensitive or red-sensitive silver halide emulsion.

These spectral sensitizers may be used alone or in combination. Spectral sensitizers are often used in combination for supersensitization. The typical examples thereof are described in Japanese Patent Publication No. 4932/1968, 4933/1968, 4936/1968, 32753/1969, 25831/1970, 26474/1970, 11627/1971, 18107/1971, 8741/1972, 11114/1872, 25379/1972, 37443/1972, 28293/1973, 38406/1973, 38407/1973, 38408/1973, 41203/1973, 41204/1973, 6207/1974, 40662/1975, 12375/1978, 34535/1979, and 1569/1980; Japanese Patent O.P.I. Publication No. 33220/1975, 33828/1975, 38526/1975, 107127/1976, 115820/1976, 135528/1976, 151527/1976, 23931/1977, 51932/1977, 104916/1977, 104917/1977, 109925/1977, 110618/1977, 80118/1979, 25728/1981, 1483/1982, 10753/1983, 91445/1983, 153926/1983, 11453/1984, 116645/1984, and 116647/1984; U.S. Pat. Nos. 2,668,545, 2,977,229, 3,397,060, 3,506,443, 3,578,447, 3,672,898, 3,679,428, 3,679,301, 3,814,609, and 3,837,862.

Dyes which are used together with spectral sensitizers and do not have spectral sensitizing action by themselves, or materials which do not substantially absorb visible light and have supersensitizing action, include a condensed product of organic aromatic acid and formaldehyde, which is described in U.S. Pat. No. 3,437,510; a cadmium salt, an azaindene compound, an amino stilbene compound replaced by a heterocyclic ring containing nitrogen, which is described in U.S. Pat. Nos. 2,933,390 and 3,635,721. The combinations of materials are very effective, which are described in U.S. Pat. Nos. 3,615,613, 3,615,641, 3,617,295, and 3,635,721.

The emulsion layers and other hydrophilic colloid layers may be hardened. A plasticizer and latex of synthetic polymer also may be contained in the layers.

The present invention is preferably applied to color photosensitive materials such as color negative films and color reversal films.

There may be incorporated into the emulsion layers of color photosensitive materials, a colored coupler, a competing coupler, and a compound capable of releasing the photographically useful fragments such as a development accelerator, a bleaching accelerator, a developing agent, a silver halide solvent, a toning agent, a hardening agent, a foggant, an antifoggant, a chemical sensitizer, a spectral sensitizer, and a desensitizer, by coupling with an oxidation product of a developing agent.

The photosensitive materials are provided with auxiliary layers such as a filter layer, an antihalation layer, an anti-irradiation layer. Dyes may be contained in these layers and/or the emulsion layers.

A formalin scavenger, a fluorescent brightening agent, a matting agent, a lubricant, an image stabilizer, a surface active agent, an antifogging agent, a development accelerator, a development inhibitor, and a bleach accelerator, can be added to the photosensitive materials.

Polyethylene laminated paper, polyethylene terephthalate film, baryta paper, and cellulose triacetate, can be used as a support.

A color picture can be obtained from the photosensitive materials of the present invention by the conventional color film processing method after exposure.

EXAMPLES

The examples of the present invention will be described as follows. The amounts of silver halide and colloidal silver are expressed by the amounts converted to silver.

EXAMPLE 1

While a solution containing 1% gelatin and potassium bromide was stirred at a temperature of 60° C., a silver nitrate solution and a solution containing at least one of potassium iodide and potassium bromide were added to the solution by the double jet method.

The content of silver iodide was adjusted by the quantity of potassium iodide, and the grain size was adjusted by varying the addition time in the range of 20 to 90 minutes, to prepare the monodispersed emulsions (A-1 to A-9) with different silver iodide contents as shown in Table 1.

TABLE 1

| | Silver iodide content (mol %) | Average grain size (μm) | Remarks |
|---|---|---|---|
| A-1 | 6 | 0.30 | |
| A-2 | 0.7 | 0.30 | |
| A-3 | 0.0 | 0.30 | Pure silver bromide |
| A-4 | 7 | 0.50 | |
| A-5 | 1.5 | 0.50 | |
| A-6 | 0.0 | 0.50 | Pure silver bromide |
| A-7 | 10.0 | 0.75 | |
| A-8 | 1.0 | 0.75 | |
| A-9 | 0.0 | 0.75 | Pure silver bromide |

The emulsions shown in Table 1 were coated on a triacetylcellulose film base to provide the emulsions having the following compositions sequently from the support side to prepare Sample 101 of a multilayered color photosensitive material.

As shown in Table 2, Samples 102 to 110 were made by changing the emulsion of each photosensitive layer and further changing the cyan couplers of the third and fourth layers.

Since Samples except Sample 101 differ in sensitivity and gradation, the amounts of a DIR compound and the spectral sensitizers were changed in order to make the levels of sensitivity and gradation as equal as possible.

The amounts of sensitizing dyes adsorbed to silver halide grains are shown in Table 3. The amounts were measured by a colorimetric determination of the concentration of a dye desorbed from silver halide grains after they were separated centrifugally from the emulsion.

Sample 101 (Comparative sample)
The first layer; Antihalation layer (HC-1)
Gelatin layer containing block colloidal silver
The second layer; Interlayer (I.L.)
Gelatin layer containing 2.5-di-t-octyl hydroquinone in
dispersion
The third layer;
Low speed red-sensitive silver halide
emulsion layer (RL-1)
Emulsion A-1 ...
Coated silver 1.5 g/m$^2$
Spectral sensitizer I ...
$6\times10^{-5}$ mol per mol of silver
Spectral sensitizer II ...
$1\times10^{-5}$ tool per tool of silver
Cyan coupler (EX-2)
0.06 mol per tool of silver
Colored cyan coupler (CC-1)
0.003 mol per mol of silver
DIR compound (D-1)
0.0015 mol per mol of silver
DIR compound (D-2)
0.002 tool per tool of silver
The fourth layer;
High speed red-sensitive silver halide
emulsion layer (RH-1)
Emulsion A-4 ...
Coated silver 1.18 g/m$^2$
Spectral sensitizer I ...
$3\times10^{-5}$ tool per tool of silver
Spectral sensitizer II ...
$1\times10^{-5}$ tool per tool of silver
Cyan coupler (Cu-28) ...
0.025 tool per tool of silver
Colored cyan coupler (CC-1) ...
0.0015 mol per mol of silver
DIR compound (D-2) ...
0.001 mol per mol of silver
The fifth layer; Interlayer (I.L.)
The same gelatin layer as the second layer
The sixth layer;
Low speed green-sensitive silver halide
emulsion layer (GL-1)
Emulsion A-1 ...
Coated silver 1.3 g/m$^2$
Spectral sensitizer III ...
$2.5\times10^{-5}$ mol per mol of silver
Spectral sensitizer IV ...
$1.2\times10^{-5}$ mol per mol of silver
Magenta coupler (M-1) ...
0.050 mol per mol of silver
Colored magenta coupler (CM-1) ...
0.009 mol of tool of silver
DIR compound (D-1) ...
0.0010 mol per tool of silver
DIR compound (D-3)
0.003 tool per tool of silver
The seventh layer;
High speed green-sensitive silver
halide emulsion layer (GH-1)
Emulsion A-4 ...
Coated silver 1.0 g/m$^2$
Spectral sensitizer III ...
$1.5\times10^{-5}$ mol per mol of silver
Spectral sensitizer IV ...
$1.0\times10^{-5}$ mol per mol of silver
Magenta coupler (M-1) ...
0.020 tool per mol of silver
Colored magenta coupler (CM-1) ...
0.002 mol per mol of silver
DIR compound (D-3)
0.0010 mol per tool of silver
The eighth layer;
Yellow filter layer (YC-1)
Gelatin layer containing yellow colloidal silver and
2.5-di-t-octyl hydroquinone in dispersion
The ninth layer;
Low speed blue-sensitive silver halide
emulsion layer (BL-1)
Emulsion A-4 ...
Coated silver 0.6 g/m$^2$
Spectral sensitizer V ...
$1.3\times10^{-5}$ mol per mol of silver
Yellow coupler (Y-1) ...
0.29 mol per mol of silver
The tenth layer;
High speed blue-sensitive emulsion
layer (BH-1)
Emulsion A-7 ...
Coated silver 0.4 g/m$^2$
Spectral sensitizer V ...
$1.0\times10^{-5}$ mol per mol of silver
Yellow coupler (Y-1) ...
0.08 mol per mol of silver DIR compound (D-2)
0.0015 mol per mol of silver The eleventh layer;
The first protective layer (Pro-1)
Silver bromoiodide (AgI: 0.3 tool%, average diameter:
0.07 μm) ...
Coated silver 0.2 g/m$^2$
Gelatin layer containing UV absorbers UV-1 and UV- 2

The twelfth layer;
The second protective layer (Pro-2)
Gelatin layer containing polymethyl methacrylate particles (diameter 1.5 μm) and formalin scavenger (HS-1)

The gelatin hardening agent (H-1) and the surface active agent were added to each layer in addition to the above-mentioned components.

The compounds contained in above each layer are as follows.

Spectral sensitizer I; Anhydro-5,5'-dichloro-9-ethyl-3,3'-di-(3-sulfopropyl) thiacarbocyanine hydroxide Spectral sensitizer II; Anhydro-9-ethyl-3,3'-di-(3-sulfopropyl)-4,5,4',5'-dibenzothia-carbocyanine hydroxide Spectral sensitizer III; Anhydro-5,5'-diphenyl-9-ethyl-3,3'-di-(3-sulfopropyl) oxacarbocyanine hydroxide Spectral sensitizer IV; Anhydro-9-ethyl-3,3'-di-(3-sulfopropyl)-5,6,5',6'-dibenzoxacarbocyanine hydroxide Spectral sensitizer V; Anhydro-3,3'-di-(3-sulfopropyl)-4,5-benzo-5'-methoxythiacyanine hydroxide

EX-1

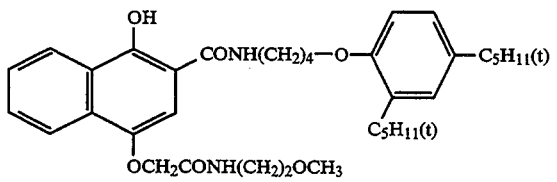

EX-2

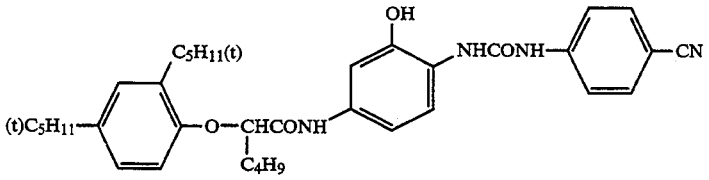

CC-1

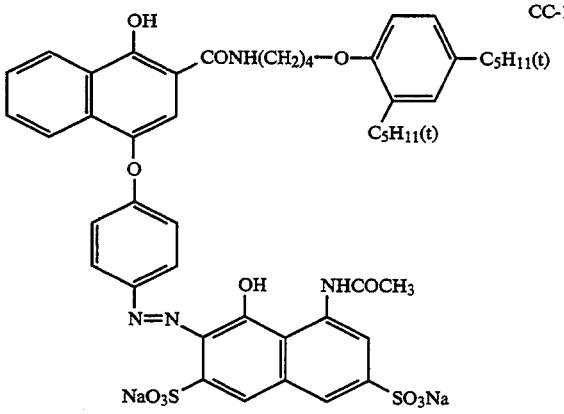

D-1

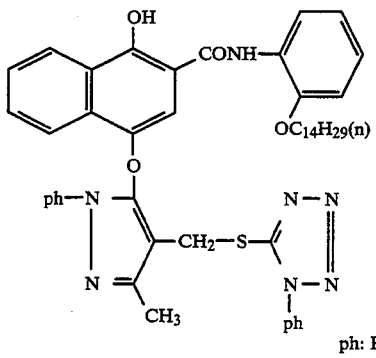

ph: Phenyl group

D-2

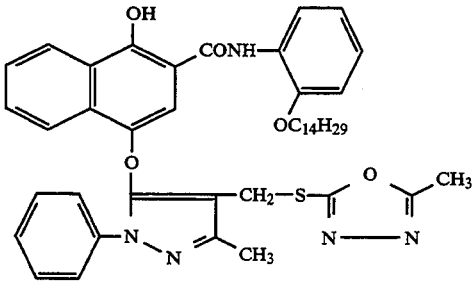

D-3

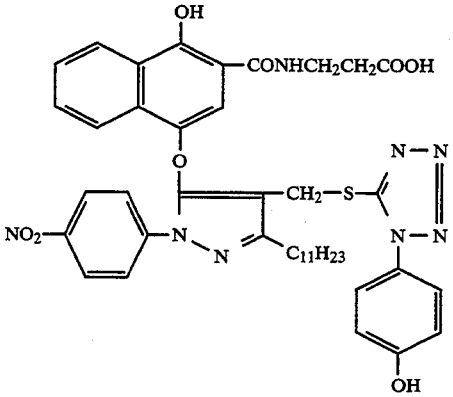

-continued

M-1

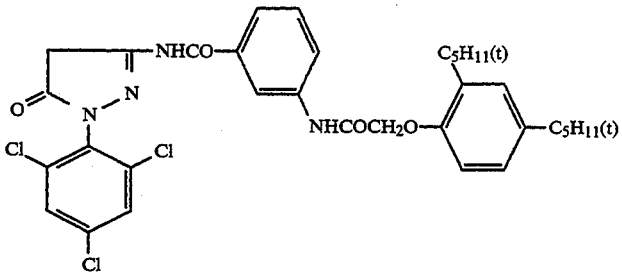

CM-2

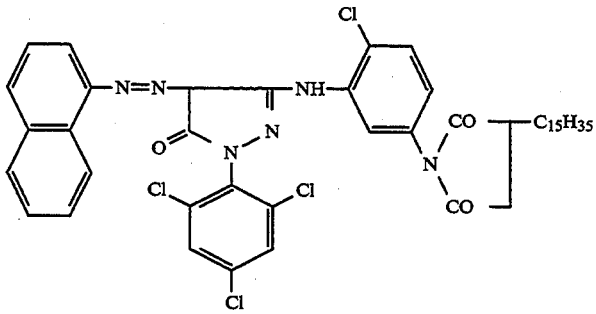

Y-1

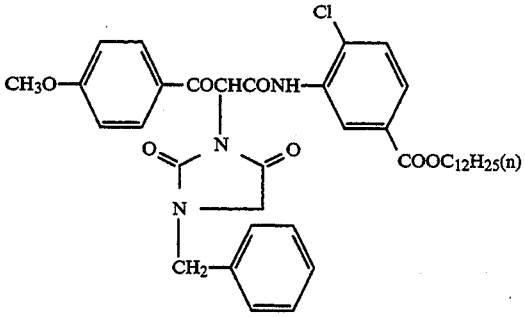

UV-1

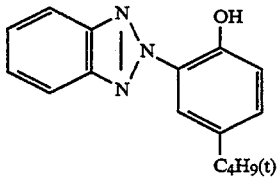

UV-2

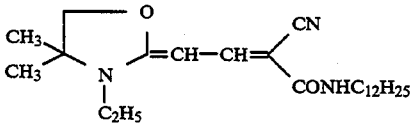

H-1

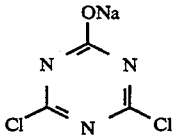

HS-1

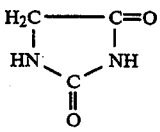

TABLE 2

| Sample No. | Cyan coupler 3rd layer | Cyan coupler 4th layer | Silver halide emulsion 3rd layer | 4th layer | 6th layer | 7th layer | 9th layer | 10th layer | Content of silver iodide (mol %) | Remarks |
|---|---|---|---|---|---|---|---|---|---|---|
| 101 | EX-2 | CU-28 | A-1 | A-4 | A-1 | A-4 | A-4 | A-7 | 6.7 | Comp. |
| 102 | EX-2 | EX-2 | A-2 | A-5 | A-2 | A-5 | A-5 | A-8 | 1.09 | Comp. |
| 103 | EX-2 | EX-1 | A-2 | A-5 | A-2 | A-5 | A-5 | A-8 | 1.09 | Comp. |
| 104 | EX-2 | CU-28 | A-2 | A-5 | A-2 | A-5 | A-5 | A-8 | 1.09 | Inv. |
| 105 | CU-28 | CU-28 | A-2 | A-5 | A-2 | A-5 | A-5 | A-8 | 1.09 | Inv. |
| 106 | EX-2 | CU-37 | A-2 | A-5 | A-2 | A-5 | A-5 | A-8 | 1.09 | Inv. |
| 107 | EX-2 | CU-28 | A-3 | A-6 | A-3 | A-6 | A-6 | A-9 | 0.0 | Inv. |
| 108 | EX-2 | CU-28 | A-3 | A-6 | A-3 | A-6 | A-6 | A-7 | 0.70 | Inv. |
| 109 | EX-2 | CU-28 | A-3 | A-6 | A-3 | A-6 | A-8 | A-7 | 0.84 | Inv. |
| 110 | EX-2 | CU-28 | A-3 | A-5 | A-3 | A-5 | A-8 | A-7 | 1.44 | Inv. |

Remarks: Comp. means a comparative example

Samples No. 101 to No. 110 with multilayer structure were exposed to white light via an optical wedge. Then,

TABLE 3

| Layer | Emulsion | Sensitizing dye: Adsorbed amount per mol of AgX | Sensitizing dye: Adsorbed amount × average grains size |
|---|---|---|---|
| 3rd | A-2 | $9.2 \times 10^{-4}$ | $2.76 \times 10^{-4}$ |
| | A-3 | $8.7 \times 10^{-4}$ | $2.61 \times 10^{-4}$ |
| 4th | A-5 | $5.8 \times 10^{-4}$ | $2.90 \times 10^{-4}$ |
| | A-6 | $5.3 \times 10^{-4}$ | $2.65 \times 10^{-4}$ |
| 6th | A-2 | $8.9 \times 10^{-4}$ | $2.67 \times 10^{-4}$ |
| | A-3 | $8.6 \times 10^{-4}$ | $2.58 \times 10^{-4}$ |
| 7th | A-5 | $5.5 \times 10^{-4}$ | $2.75 \times 10^{-4}$ |
| | A-6 | $5.2 \times 10^{-4}$ | $2.60 \times 10^{-4}$ |
| 9th | A-5 | $6.2 \times 10^{-4}$ | $3.10 \times 10^{-4}$ |
| | A-6 | $5.8 \times 10^{-4}$ | $2.90 \times 10^{-4}$ |
| | A-8 | $3.9 \times 10^{-4}$ | $2.93 \times 10^{-4}$ |
| 10th | A-8 | $3.9 \times 10^{-4}$ | $2.93 \times 10^{-4}$ |
| | A-9 | $3.6 \times 10^{-4}$ | $2.70 \times 10^{-4}$ |

| Process A (38° C.) | |
|---|---|
| Color development | 3 minutes 15 seconds |
| Bleach | 6 minutes 30 seconds |
| Washing | 3 minutes 15 seconds |
| Fixing | 6 minutes 30 seconds |
| Washing | 3 minutes 15 seconds |
| Stabilization | 1 minute 30 seconds |

The composition of the processing solution used in each process are as follows.

| | |
|---|---|
| Color developer | |
| 4-amino-3-methyl-N-ethyl-N-(β-hydroxyethyl) aniline sulfate | 4.75 g |
| Sodium sulfite anhydride | 4.25 g |
| Hydroxylamine ½ sulfate | 2.0 g |
| Potassium carbonate anhydride | 37.5 g |
| Sodium bromide | 1.3 g |
| Formalin (37% aqueous solution) | 1.5 ml |
| Konidax (manufactured by Konica Co.) | 7.5 ml |
| Nitrilotriacetic acid trisodium salt (monohydrate) | 2.5 g |
| Potassium hydroxide | 1.0 g |
| Water is added to make total quantity 1 liter. | |
| Bleaching solution | |
| Ferric ethylenediamine tetracetate ammonium salt | 100.0 g |
| Ethylenediamine tetracetate diammonium salt | 10.0 g |
| Ammonium bromide | 150.0 g |
| Glacial acetic acid | 10 ml |
| Water is added to make total quantity 1 liter. | |
| pH was adjusted to 6.0 with aqueous ammonia. | |
| Fixing solution | |
| Ammonium thiosulfate | 175.0 g |
| Sodium sulfite anhydride | 8.5 g |
| Sodium metasulfite | 2.3 g |
| Water is added to make total quantity 1 liter. | |
| pH was adjusted to 6.0 with acetic acid. | |
| Stabilizer | |
| Formalin (37% aqueous solution) | 1.5 ml |
| Konidax (manufactured by Konica Co.) | 7.5 ml |
| Water is acided to make total quantity 1 liter. | |

The other of the exposed samples divided into two pieces was processed in the process B where the color development and color developer in the process A were changed as follows.

| Process B | |
|---|---|
| Color development 90 seconds (40°) | |
| Color developer | |
| 4-amino-3-methyl-N-(β-hydroxyethyl) aniline sulfate | 11.1 g |
| Sodium sulfite anhydride | 4.25 g |

-continued

| Process B | |
|---|---|
| Hydroxylamine ½ sulfate | 2.0 g |
| Potassium carbonate anhydride | 30.0 g |
| Sodium bromide | 1.3 g |
| Nitrilotriacetic acid trisodium salt (monohydrate) | 2.5 g |
| Potassium hydroxide | 1.0 g |
| Water was added to make total 1 liter. | (pH = 10.2) |

The minimum density (Dmin) and the maximum density (Dmax) of the samples subjected to the process A and B were measured, and the differences in Dmax and Dmin was calculated as follows.

$\Delta Dmin = |D^{B}min - D^{A}min|$ $\Delta Dmax = |D^{B}max - D^{A}max|$ $D^{B}min$: Dmin of the samples processed in Process B $D^{A}min$: Dmin of the samples processed in Process A $D^{B}max$: Dmax of the samples processed in Process B $D^{A}max$: Dmax of the samples processed in Process A

TABLE 4

| Sample No. | Variation in rapid processing: Δ Dmin B | Δ Dmin G | Δ Dmin R | Δ Dmax B | Δ Dmax G | Δ Dmax R |
|---|---|---|---|---|---|---|
| 101 (Comp.) | 0.15 | 0.14 | 0.13 | 0.25 | 0.23 | 0.21 |
| 102 (Comp.) | 0.18 | 0.16 | 0.14 | 0.30 | 0.27 | 0.27 |
| 103 (Comp.) | 0.19 | 0.17 | 0.15 | 0.32 | 0.28 | 0.28 |
| 104 (Inv.) | 0.04 | 0.04 | 0.05 | 0.15 | 0.19 | 0.17 |
| 105 (Inv.) | 0.05 | 0.05 | 0.06 | 0.16 | 0.18 | 0.17 |
| 106 (Inv.) | 0.05 | 0.04 | 0.04 | 0.15 | 0.18 | 0.16 |
| 107 (Inv.) | 0.05 | 0.04 | 0.04 | 0.12 | 0.14 | 0.13 |
| 108 (Inv.) | 0.06 | 0.05 | 0.05 | 0.14 | 0.16 | 0.15 |
| 109 (Inv.) | 0.06 | 0.05 | 0.05 | 0.14 | 0.15 | 0.15 |
| 110 (Inv.) | 0.07 | 0.07 | 0.06 | 0.14 | 0.14 | 0.16 |

As apparent from the results shown in Table 4, the samples of the invention have less variations in rapid processing, ΔDmin and ΔDmax, than the comparative samples.

The same results were confirmed in the samples where CU-28 in Sample 108 was replaced with CU-1 and CU-10.

EXAMPLE 2

Each sample made in Example 1 was divided into two pieces and one of them was subjected to aging by standing at 40° C. and RH70% over a period of six weeks. The aged sample and the unaged one were processed in the process A after subjecting to exposure via wedge in the same manner as Example 1 to prepare Samples 201 to 210. ΔDmin and ΔDmax were calculated as well.

ΔDmin = |Dmin of aged sample—Dmin of unaged sample|

ΔDmax = |Dmax of aged sample—Dmax of unaged sample|

The results are shown in Table 5.

TABLE 5

| Sample No. | Antiaging property Δ Dmin B | G | R | Δ Dmax B | G | R |
|---|---|---|---|---|---|---|
| 201 (Comp.) | 0.45 | 0.30 | 0.19 | 0.10 | 0.25 | 0.23 |
| 202 (Comp.) | 0.37 | 0.26 | 0.17 | 0.18 | 0.33 | 0.29 |
| 203 (Comp.) | 0.38 | 0.25 | 0.17 | 0.19 | 0.32 | 0.28 |
| 204 (Inv.) | 0.17 | 0.10 | 0.09 | 0.11 | 0.16 | 0.13 |
| 205 (Inv.) | 0.16 | 0.12 | 0.12 | 0.10 | 0.17 | 0.17 |
| 206 (Inv.) | 0.17 | 0.11 | 0.09 | 0.08 | 0.16 | 0.14 |
| 207 (Inv.) | 0.18 | 0.10 | 0.08 | 0.09 | 0.15 | 0.11 |
| 208 (Inv.) | 0.19 | 0.13 | 0.10 | 0.09 | 0.16 | 0.15 |
| 209 (Inv.) | 0.20 | 0.11 | 0.09 | 0.11 | 0.13 | 0.12 |
| 210 (Inv.) | 0.21 | 0.12 | 0.09 | 0.13 | 0.14 | 0.12 |

As apparent from the results shown in Table 5, the samples of the invention have more excellent antiaging properties in both Dmin and Dmax than the comparative samples.

The same results were confirmed in the samples where CU-28 in Sample 208 was replaced with CU-1 and CU-10.

EXAMPLE 3

Samples 301,302, 303, and 304 were made by adding a gallic acid derivative (I-6) in 0.80 g/mol of silver to the third, fourth, sixth, seventh, ninth, and tenth layers of Samples 103,104,107, and 109 in Example 1. Those samples were evaluated for the variation in rapid processing in Example 1 and for the antiaging property in Example 2. The results are shown in Table 6.

TABLE 6

| Sample No. | Variation in rapid processing Δ Dmin B | G | R | Δ Dmax B | G | R | Antiaging property Δ Dmin B | G | R | Δ Dmax B | G | R |
|---|---|---|---|---|---|---|---|---|---|---|---|---|
| 301 (Comp.) | 0.17 | 0.15 | 0.13 | 0.32 | 0.26 | 0.26 | 0.33 | 0.21 | 0.15 | 0.18 | 0.32 | 0.25 |
| 302 (Inv.) | 0.02 | 0.02 | 0.03 | 0.12 | 0.14 | 0.12 | 0.12 | 0.06 | 0.05 | 0.08 | 0.13 | 0.10 |
| 303 (Inv.) | 0.02 | 0.02 | 0.02 | 0.10 | 0.11 | 0.09 | 0.11 | 0.04 | 0.04 | 0.07 | 0.12 | 0.09 |
| 304 (Inv.) | 0.03 | 0.02 | 0.02 | 0.11 | 0.12 | 0.11 | 0.16 | 0.07 | 0.06 | 0.07 | 0.09 | 0.08 |

It has been found from the results shown in Table 6 that the samples of the present invention are further improved in the variation in rapid processing and antiaging property than the comparative samples by adding a gallic acid derivative.

The same results were confirmed in the sample where a gallic acid derivative I-6 in Sample 303 was replaced with II-3.

EXAMPLE 4

In Samples No. 103,104 and 107, the amounts of sensitizing dyes adsorbed to silver halide grains were changed as shown in Table 7 to prepare Samples 401,402 and 403. The amounts adsorbed were adjusted by controlling an addition amount and an adding method.

These samples were processed and evaluated in the same way as in Example 1. The results are shown in Table 8.

TABLE 7

| Sample No. | | 3rd layer | 4th layer | 6th layer | 7th layer | 9th layer | 10th layer |
|---|---|---|---|---|---|---|---|
| 401 | Emulsion | A-2 | A-5 | A-2 | A-5 | A-5 | A-8 |
| | Adsorbed amount of sensitizing dye | $7.0 \times 10^{-4}$ | $4.0 \times 10^{-4}$ | $4.5 \times 10^{-4}$ | $3.5 \times 10^{-4}$ | $3.7 \times 10^{-4}$ | $1.5 \times 10^{-4}$ |
| | Adsorbed amount × ave. grain size | $2.10 \times 10^{-4}$ | $2.00 \times 10^{-4}$ | $1.35 \times 10^{-4}$ | $1.75 \times 10^{-4}$ | $1.85 \times 10^{-4}$ | $1.13 \times 10^{-4}$ |
| 402 | Emulsion | A-2 | A-5 | A-2 | A-5 | A-5 | A-8 |
| | Adsorbed amount of sensitizing dye | $7.0 \times 10^{-4}$ | $4.0 \times 10^{-4}$ | $4.5 \times 10^{-4}$ | $3.5 \times 10^{-4}$ | $3.7 \times 10^{-4}$ | $1.5 \times 10^{-4}$ |
| | Adsorbed amount × ave. grain size | $2.10 \times 10^{-4}$ | $2.00 \times 10^{-4}$ | $1.35 \times 10^{-4}$ | $1.75 \times 10^{-4}$ | $1.85 \times 10^{-4}$ | $1.13 \times 10^{-4}$ |
| 403 | Emulsion | A-3 | A-6 | A-3 | A-6 | A-6 | A-9 |
| | Adsorbed amount of sensitizing dye | $6.5 \times 10^{-4}$ | $3.6 \times 10^{-4}$ | $3.7 \times 10^{-4}$ | $2.5 \times 10^{-4}$ | $3.4 \times 10^{-4}$ | $1.0 \times 10^{-4}$ |
| | Adsorbed amount × ave. grain size | $1.95 \times 10^{-4}$ | $1.80 \times 10^{-4}$ | $1.11 \times 10^{-4}$ | $1.25 \times 10^{-4}$ | $1.70 \times 10^{-4}$ | $0.75 \times 10^{-4}$ |

TABLE 8

| Sample No. | Variation in rapid processing Δ Dmin B | G | R | Δ Dmax B | G | R |
|---|---|---|---|---|---|---|
| 103 | 0.19 | 0.17 | 0.15 | 0.32 | 0.28 | 0.28 |
| 104 | 0.04 | 0.04 | 0.05 | 0.15 | 0.19 | 0.17 |
| 107 | 0.05 | 0.04 | 0.04 | 0.12 | 0.14 | 0.13 |
| 401 | 0.20 | 0.18 | 0.16 | 0.33 | 0.29 | 0.27 |
| 402 | 0.07 | 0.07 | 0.07 | 0.17 | 0.21 | 0.21 |
| 403 | 0.07 | 0.07 | 0.07 | 0.15 | 0.20 | 0.18 |

As can be seen from Table 8, if the value obtained by multiplying an adsorbed amount of a sensitizing dye by an average grain size of silver halide grains is not less than $2.55 \times 10^{-4}$, a variation in rapid processing is more improved.

What is claimed is:

1. A silver halide photographic light-sensitive material comprising a support having provided thereon, photographic component layers including a plurality of silver halide emulsion layers containing photosensitive silver halide grains, said silver halide grains in all silver halide emulsion layers of said material consisting essentially of silver bromide or silver bromoiodide, an average silver iodide content of the combined emulsions used to form all said silver halide emulsion layers being 0 mol % to 3 mol %; at least one of said silver halide emulsion layers containing a two-equivalent phenolic cyan dye-forming coupler having a ureido group in a two-position of a phenolic nucleus.

2. The photographic material of claim 1, wherein said average silver iodide content ranges from 0.05 to 2.5 mol %.

3. The photographic material of claim 2, wherein said average silver iodide content ranges from 0.10 to 2.0 mol %.

4. The photographic material of claim 1, wherein said di-equivalent phenolic cyan dye-forming coupler is represented by Formula (CU):

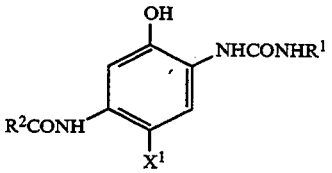

Formula (CU)

wherein $R^1$ represents an aryl group or a heterocyclic group, and $R^2$ represents an aliphatic group or an aryl group, provided that the groups represented by $R^1$ and $R^2$ may have substituents; $X^1$ represents a group capable of splitting off by coupling with an oxidation product of a developing agent; provided that a polymer coupler having diequivalence or more may be formed via $R^1$ or $R^2$, and that at least one of $R^1$ and $R^2$ has a form or a size necessary to give anti-diffusibility to said coupler and a dye formed by said coupler.

5. The photographic material of claim 4, wherein the aryl group represented by $R^1$ or $R^2$ is a phenyl group or a naphthyl group.

6. The photographic material of claim 4, wherein said substituents for $R^1$ and $R^2$ are independently a nitro group, a cyano group, a halogen atom, an alkyl group, an aryl group, an amino group, a hydroxy group, an acyl group, an alkoxycarbonyl group, an aryl-oxycarbonyl group, an alkylsulfonyl group, an arylsulfonyl group, an alkoxysulfonyl group, an aryloxysulfonyl group, a carbamoyl group, a sulfamoyl group, an acyloxy group, a carbonamide group, and a sulfonamide group.

7. The photographic material of claim 6, wherein the number of said substituents is 1 to 5, provided that the substituents may be the same or different when said number is two or more.

8. The photographic material of claim 6, wherein said substituents for $R^1$ are an alkylsulfonyl group, a cyano group and a halogen atom.

9. The photographic material of claim 6, wherein $R^2$ is represented by Formula (CU-II):

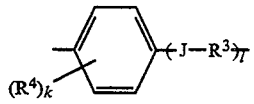

Formula (CU-II)

wherein $R^3$ represents an alkylene group; $R^4$ represents a substituent; J represents an oxygen atom or a sulfur atom; k represents an integer of 0 to 4, provided that $R^4$'s may be the same or different when k is two or more; λis 0 or 1.

10. The photographic material of claim 9, wherein said substituent represented by $R^4$ is an alkyl group, an aryl group, an alkoxy group, an aryloxy group, a hydroxy group, an acyloxy group, an alkylcarbonyloxy group, an arylcarbonyloxy group, a carboxy group, an alkoxycabonyl group, an aryloxycarbonyl group, an alkylthio group, an acyl group, an acylamino group, a sulfonamide group, a carbamoyl group, and a sulfamoyl group.

11. The photographic material of claim 4, wherein $X^1$ is a halogen atom, an aryloxy group, an alkyloxy group, an arylthio group, an alkylthio group, a carbamoyloxy group, a carbamoylmethoxy group, an acyloxy group, a sulfonamide group, or a succinateimide group, each group combining directly to a coupling site of a phenolic nucleus via an oxygen atom, a sulfur atom or a nitrogen atom contained in each group.

12. The photographic material of claim 4, wherein a content of said coupler is $1.0\times10^{-3}$ to 1.0 mol per mol of silver halide.

13. The photographic material of claim 12, wherein said content is $3.0\times10^{-3}$ to $6.0\times10^{-1}$ mol per mol of silver halide.

14. The photographic material of claim 1, wherein said photographic material further contains at least one of gallic ester and gallic amide represented by Formulas (I) and (II):

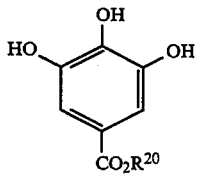

Formula (I)

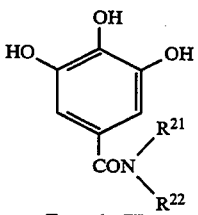

Formula (II)

wherein $R^{20}$, $R^{21}$ and $R^{22}$represent independently a hydrogen atom, an aliphatic group, an aromatic group, and a heterocyclic group.

15. The photographic material of claim 14, whererin said aliphatic group is an alkyl group, an alkenyl group, a cycloalkyl group, or an alkynyl group.

16. The photographic material of claim 15, whererin said alkyl group has 1 to 30 carbon atoms.

17. The photographic material of claim 16, whererin said alkyl group has 1 to 20 carbon atoms.

18. The photographic material of claim 15, whererin said alkenyl group has 2 to 30 carbon atoms.

19. The photographic material of claim 18, whererin said alkenyl group has 3 to 20 carbon atoms.

20. The photographic material of claim 15, whererin said cycloalkyl group is a 3- to 12-membered ring.

21. The photographic material of claim 20, whererin said cycloalkyl group is a 5- to 7-membered ring.

22. The photographic material of claim 15, whererin said alkynyl group has 3 to 30 carbon atoms.

23. The photographic material of claim 22, whererin said alkynyl group has 3 to 22 carbon atoms.

24. The photographic material of claim 14, whererin said aromatic group represented by $R^{20}$, $R^{21}$ or $R^{22}$ is a phenyl group or a naphthyl group.

25. The photographic material of claim 14, whererin said heterocyclic group represented by $R^{20}$, $R^{21}$ or $R^{22}$ is a thiazolyl group, an oxazolyl group, an imidazolyl group, a furyl group, a thienyl group, a tetrahydrofuryl group, a piperidyl group, a thiadiazolyl group, an oxadiazolyl group, a benzothiazolyl group, a benzoxazolyl group, or a benzimidazolyl group.

26. The photographic material of claim 1, further containing a sensitizing dye.

27. The photographic material of claim 26, wherein the value obtained by multiplying the amount per mol of silver halide of the sensitizing dye adsorbed to silver halide grains by an average grain size of said silver halide grains is $2.55\times10^{-4}$ or more.

28. The photographic material of claim 26 wherein said sensitizing dye is selected from a cyanine dye, a merocyanine dye and a complex merocyanine dye.

29. The photographic material of claim 1 wherein said silver halide emulsion layers comprise a red-sensitive silver halide emulsion layer, a green-sensitive silver halide emulsion layer and a blue-sensitive silver halide emulsion layer.

30. The photographic material of claim 29 wherein said red-sensitive silver halide emulsion layer and green-sensitive silver halide emulsion layer each comprise a silver iodide content ranging from 0 to 3 mol %.

* * * * *